US006442778B1

(12) United States Patent
Shaharbani

(10) Patent No.: US 6,442,778 B1
(45) Date of Patent: Sep. 3, 2002

(54) ADJUSTABLE SUPPORT PILLOW

(76) Inventor: Nissim Shaharbani, Weizmann St. 50, Kfar Saba (IL), 44247

( * ) Notice: Subject to any disclaimer, the term of this patent is extended or adjusted under 35 U.S.C. 154(b) by 0 days.

(21) Appl. No.: 09/367,680

(22) PCT Filed: Jan. 30, 1998

(86) PCT No.: PCT/IL98/00045

§ 371 (c)(1),
(2), (4) Date: Nov. 2, 1999

(87) PCT Pub. No.: WO98/38892

PCT Pub. Date: Sep. 11, 1998

(30) Foreign Application Priority Data

Mar. 5, 1997 (IL) ..... 120378

(51) Int. Cl.[7] ..... A47G 9/00
(52) U.S. Cl. ..... 5/636; 5/645; 5/640
(58) Field of Search ..... 5/630, 632, 636, 5/640, 645

(56) References Cited

U.S. PATENT DOCUMENTS

| | | | | |
|---|---|---|---|---|
| 247,892 A | | 10/1881 | Doremus | 5/640 |
| 260,870 A | | 7/1882 | Huse | 5/645 |
| 395,043 A | | 12/1888 | Doremus | 5/640 |
| 1,385,355 A | | 7/1921 | Banks | 5/636 |
| 1,447,288 A | | 3/1923 | Emmerich | 5/645 |
| 2,013,481 A | | 9/1935 | Stonehill | 155/188 |
| 3,293,671 A | | 12/1966 | Griffin | 5/355 |
| 3,443,267 A | | 5/1969 | Schuckman | 5/341 |
| 3,849,810 A | | 11/1974 | Degen | 5/341 |
| 4,394,783 A | | 7/1983 | Simmons | 5/432 |
| 4,660,239 A | | 4/1987 | Thomas | 5/434 |
| 4,768,248 A | | 9/1988 | O'Sullivan | 5/437 |
| 4,829,614 A | | 5/1989 | Harper | 5/436 |
| 4,843,666 A | | 7/1989 | Elesh et al. | 5/447 |
| 4,908,894 A | | 3/1990 | Sanders | 5/436 |
| 5,231,720 A | | 8/1993 | Benoff | 5/644 |
| 5,363,524 A | | 11/1994 | Lang | 5/640 |
| 5,367,731 A | | 11/1994 | O'Sullivan | 5/645 |
| 5,388,295 A | | 2/1995 | Sarkozi | 5/630 |
| 5,437,070 A | | 8/1995 | Rempp | 5/636 |
| 5,479,667 A | | 1/1996 | Nelson et al. | 5/636 |
| 5,528,784 A | | 6/1996 | Painter | 5/640 |
| 5,572,757 A | | 11/1996 | O'Sullivan | 5/636 |
| 5,918,333 A | * | 7/1999 | Takashima | 5/645 X |
| 5,987,676 A | * | 11/1999 | Littleford et al. | 5/636 |

FOREIGN PATENT DOCUMENTS

| | | |
|---|---|---|
| GB | 26072 | 12/1909 |

* cited by examiner

*Primary Examiner*—Lynne H. Browne
*Assistant Examiner*—Robert G. Santos
(74) *Attorney, Agent, or Firm*—Abelman, Frayne & Schwab

(57) ABSTRACT

A support pillow including a plurality of compartments each at least partially filled with a soft, yielding material and covered with a tick, each compartment being attached to another compartment along adjacent side edges thereof so as to form an endless, jointed roll of the compartments, the attached side edges defining joints between each compartment.

3 Claims, 2 Drawing Sheets

ADJUSTABLE SUPPORT PILLOW

FIELD OF THE INVENTION

The present invention relates generally to adjustable support pillows.

BACKGROUND OF THE INVENTION

Many types of adjustable support pillows are known. For example, U.S Pat. No. 247,892 to Doremus describes a pillow or bolster constructed of a central roll surrounded by two or more parallel rows connected with the central roll along its sides.

A related patent. U.S. Pat. No. 395,043 to Doremus, describes a removable pillow cover or slip with a series of longitudinal compartments secured together in parallel relation with each other on adjacent sides intermediate the entire cluster and adapted to contain independent, separately-covered rolls or pillows.

U.S. Pat. No. 1,385,355 to Banks describes a pillow comprising three sections, two end sections being identical and including relatively thick portions filled with a non-compressible material, and a relatively thin central section located between and connected to the end sections and filled with a soft yielding material.

U.S. Pat. No. 1,447,288 to Emmerich describes a pillow comprising a filled enclosure having substantially twice the width and half the thickness of the normal width and thickness of the pillow and adapted to be folded upon itself along a median line, the two halves of the enclosure being filled respectively with relatively hard and soft material, a casing adapted to contain the filled enclosure when folded upon itself, and means for fastening the casing.

U.S. Pat. No. 3,849,810 to Degen describes a pillow that includes a case with an opening therein having a first fastening device for opening and closing it. The pillow contains a first main stuffing and a second auxiliary stuffing that is inserted in the opening.

U.S. Pat. No. 4,829,614 to Harper describes an adjustable pillow with adjustable neck support having a main portion and a neck support portion. A plurality of separately inflatable members are positioned in chambers that are surrounded and separated by cushioning material.

Other adjustable pillows representative of the art include U.S. Pat. Nos. 4,660,239, 4,768,248, 4,908,894, 5,231,720, 5,363,524, 5,367,731, 5,437,070, and 5,479,667.

SUMMARY OF THE INVENTION

The present invention seeks to provide a novel adjustable support pillow formed as an endless, jointed roll of soft, stuffed compartments. The compartments may be rolled or otherwise suitably arranged so as to optimize a comfortable supporting configuration of the pillow.

It is noted that throughout the specification and claims the term "pillow" encompasses any support structure for resting thereon a part of a body, such as a pillow, mattress, upholstered seat, cushion and the like.

There is thus provided in accordance with a preferred embodiment of the present invention a support pillow including a plurality of compartments each at least partially filled with a soft, yielding material and covered with a tick, each compartment being attached to another compartment along adjacent side edges thereof so as to form an endless, jointed roll of the compartments, the attached side edges defining joints between each compartment.

In accordance with a preferred embodiment of the present invention, at least two of the compartments have unequal thicknesses.

Additionally in accordance with a preferred embodiment of the present invention, at least two of the compartments are detachable from each other.

Further in accordance with a preferred embodiment of the present invention, at least one of the ticks comprises a first portion and a second portion attached together, the first portion being larger than the second portion. Preferably the first portion and the second portion have an arcuate cross section and the first portion has a larger radius of curvature than that of the second portion.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
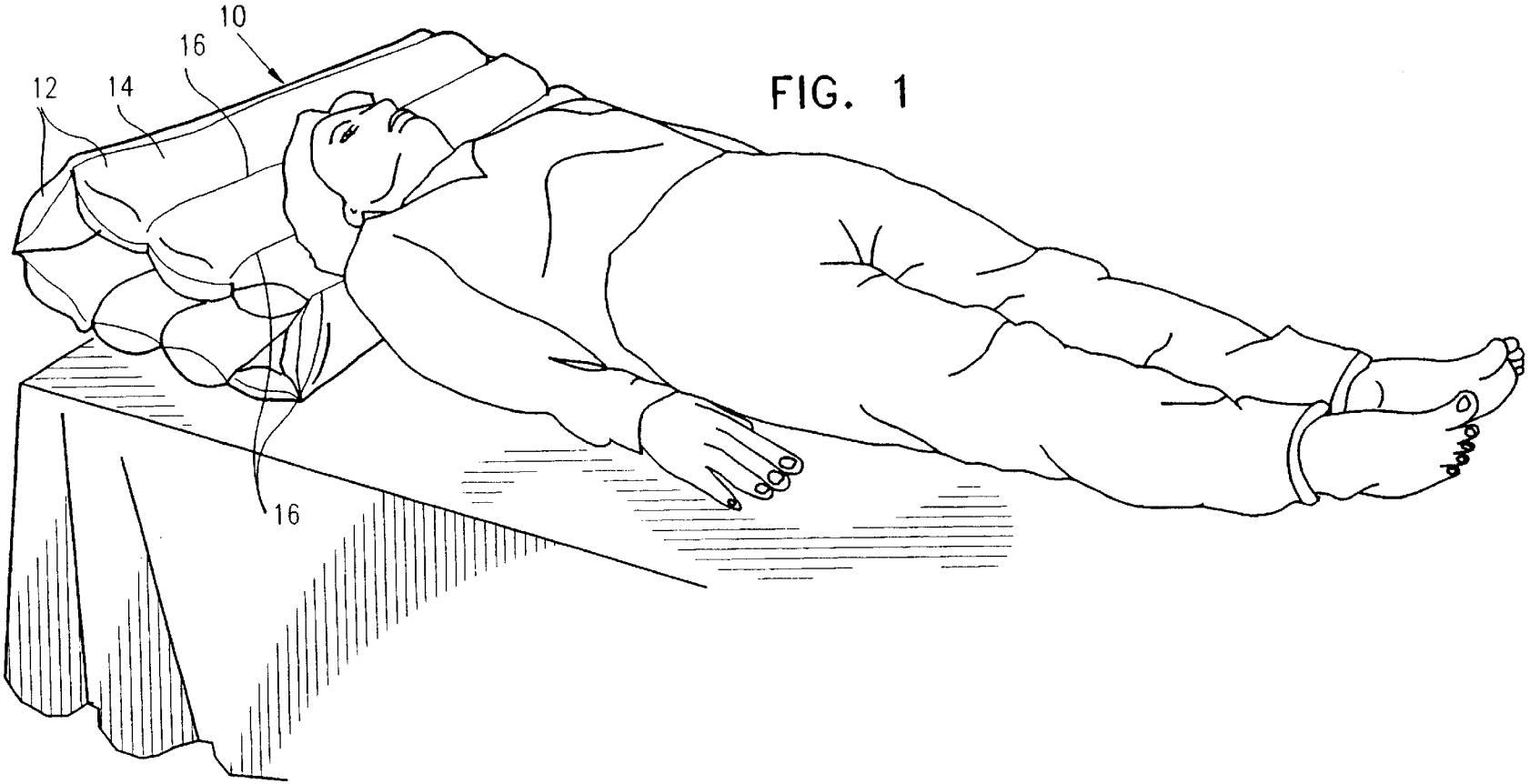
FIG. 1 is a simplified illustration of an adjustable support pillow in the form of a continuous roll, constructed and operative in accordance with a preferred embodiment of the present invention.
Figure 2:
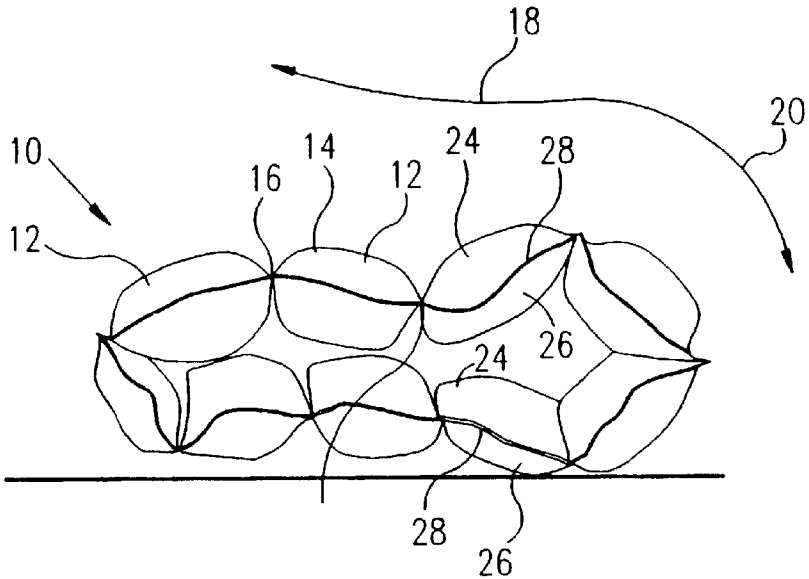
FIG. 2 is a simplified side view illustration of the adjustable support pillow of FIG. 1.

Reference is now made to FIGS. 1 and 2 which illustrate an adjustable support pillow 10, constructed and operative in accordance with a preferred embodiment of the present invention.

Support pillow 10 preferably includes a plurality of compartments 12, each at least partially filled with a soft, yielding material, such as down, feathers, or a soft mass of natural or synthetic fibers. Each compartment 12 is covered with a tick 14, typically fabricated from a cloth material, such as cotton, and which may include a decorative pattern as desired. Each compartment 12 is preferably attached to another compartment 12 along adjacent side edges 16 thereof. The compartments 12 may be permanently attached such as by sewing or any other convenient means of attachment, or may be detachably attached such as by a zipper (as will be described hereinbelow with reference to FIG. 3) or any other convenient means of detachable attachment. The attached compartments 12 form an endless, jointed roll, wherein the attached side edges 16 behave as joints between each compartment 12. Compartments 12 may be rolled generally in the direction of arrows 18 and 20, as shown in FIG. 2, so as to modify the orientation of compartments 12 with one another. As appreciated from FIG. 1, a user may roll or otherwise suitably arrange compartments 12 of pillow 10 so as to optimize a comfortable supporting configuration of pillow 10 for his/her head or other part of body.

Figure 3:
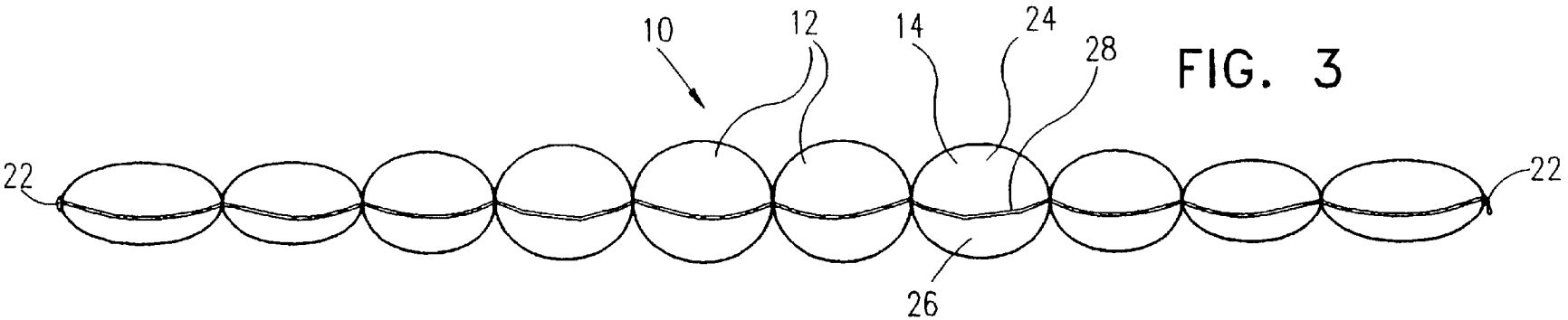
FIG. 3 is a simplified illustration of the adjustable support pillow of FIG. 1 wherein a compartment of the pillow has been detached from another compartment and the pillow is laid flat.

Reference is now made to FIG. 3 which illustrates one compartment 12 of pillow 10 detachably attached to another compartment 12 by means of a zipper 22. FIG. 3 illustrates that zipper 22 may be used to detach one compartment 12 from another so as to enable laying pillow 10 flat.

Referring additionally again to FIG. 2, two or more compartments 12 preferably have unequal thicknesses, typically achieved by stuffing ticks 14 with unequal amounts of material and/or different kinds of material.

In accordance with a preferred embodiment of the present invention, at least one, and preferably all, of the ticks 14 comprises a first portion 24 and a second portion 26 attached together, such as by sewing along an edge 28. First portion 24 is preferably larger than second portion 26. In addition, first and second portions 24 and 26 have an arcuate cross section, wherein first portion 24 has a larger radius of curvature than a radius of curvature of second portion 26. The unequal size of first and second portions 24 and 26 increases the possibilities of orienting pillow 10 to a desired level of comfort.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A support pillow comprising:

a plurality of compartments each at least partially filed with a soft, yielding material and covered with a tick, each compartment being attached to another compartment along adjacent side edges thereof so as to form an endless, jointed roll of said compartments, said attached side edges defining joints between each compartment;

characterized in that at least two of said compartments have unequal thicknesses and in that at least two of said compartments are detachable form each other wherein said at least two detachable compartments are of lesser thickness than compartments attached therebetween.

2. A support pillow according to claim 1 wherein at least one of said ticks comprises a first portion and a second portion attached together, said first portion being larger than said second portion.

3. A support pillow according to claim 2 wherein said first portion and said second portion have an arcuate cross section and said first portion has a larger radius of curvature than that of said second portion.

* * * * *